US007374454B1

(12) United States Patent
Wang

(10) Patent No.: US 7,374,454 B1
(45) Date of Patent: May 20, 2008

(54) WALL PLATE ASSEMBLY

(75) Inventor: Chang-Ping Wang, Yung-Ho (TW)

(73) Assignee: Sure-Fire Electrical Corporation, Taipei Hsien (TW)

( * ) Notice: Subject to any disclaimer, the term of this patent is extended or adjusted under 35 U.S.C. 154(b) by 0 days.

(21) Appl. No.: 11/758,002

(22) Filed: Jun. 5, 2007

(51) Int. Cl.
*H01R 13/60* (2006.01)

(52) U.S. Cl. ..... 439/536; 439/373

(58) Field of Classification Search ..... 439/536, 439/373; 174/66
See application file for complete search history.

(56) References Cited

U.S. PATENT DOCUMENTS 1,184,105 A * 5/1916 Klein ..... 200/51.09
4,411,485 A * 10/1983 Wiseheart et al. ..... 439/343
4,875,880 A * 10/1989 Welch et al. ..... 439/536
5,124,506 A * 6/1992 Briggs et al. ..... 174/67
5,645,449 A * 7/1997 Sabo ..... 439/540.1
5,683,166 A * 11/1997 Lutzker ..... 362/84
6,213,815 B1 * 4/2001 Wu ..... 439/638
6,793,524 B2 * 9/2004 Clark et al. ..... 439/536
7,054,442 B2 * 5/2006 Weikle ..... 379/438
2003/0048895 A1 * 3/2003 Kiko et al. ..... 379/390.02
2007/0037442 A1 * 2/2007 Sullivan et al. ..... 439/535
2007/0275595 A1 * 11/2007 Hazani et al. ..... 439/536

FOREIGN PATENT DOCUMENTS

JP 56008732 A * 1/1981

* cited by examiner

*Primary Examiner*—Tulsidas C. Patel
*Assistant Examiner*—Vladimir Imas

(57) ABSTRACT

A wall plate assembly includes a wall plate with an insertion slot for the installation of a HDMI (High-Definition Multimedia Interface) connector of a HDMI cable, a signal amplifier connected to the back side of the wall plate for receiving the installed HDMI connector and amplifying the signal, and a support device, which comprises a vertical support frame vertically adjustably fastened to the wall plate below the insertion slot and a horizontal support frame horizontally adjustably fastened to the vertical support frame for holding down the installed HDMI connector on the vertical support frame.

7 Claims, 8 Drawing Sheets

WALL PLATE ASSEMBLY

BACKGROUND OF THE INVENTION

1. Field of the Invention

The present invention relates to a wall plate structure for receiving a HDMI (High-Definition Multimedia Interface) connector and more particularly, to a wall plate assembly that has support means adjustable to hold down the installed HDMI connector.

2. Description of the Related Art

Following fast development of high technology, advanced and sophisticated consumer electronic products are continuously created and put into market. In a house, many electric cables and connection devices may be arranged on the ceiling, wall or floor for the installation of electronic products. Arranging electric cables and connection devices on the outside of the ceiling, wall or floor destructs the sense of beauty of the house. Further, it is not safe to have electric cables and connection devices exposed to the outside. In a modern building, electric cables and connection devices are embedded in the ceiling, wall or floor, and wall plates are provided on the outside of the ceiling, wall or floor for the installation of an electronic product.

Further, following fast development of modern technology, LCD and plasma monitors and televisions are created to substitute for the early design of CRT monitors and televisions. Modern color video monitors and televisions provide high-definition, high-contrast and colorful images. Further, the number of TV channels has also been increased from the early limited number to the modern several hundred channels. Previously, one may use a video tape recorder and player to play videotapes. However, a videotape has a big size.

Further, a videotape tends to be damped to go mouldy. Therefore, VCD and DVD players are created to substitute for videotape recorders and players. A VCD or DVD player needs a signal cable to transmit audio and video signals to a television. An early design of signal cable for this purpose is a DVI (Digital Video Interleaved) compression/decompression (codec) format based on the Intel i750 chipset and used for storing video on digital media and supported through the Media Control Interface (MCI) for Windows. It is based on a VQ (vector quantization) algorithm. There are two formats: a symmetric real-time video (RTV) codec and an asymmetric production-level video (PVL). The compression ratio is within 80:1~200:1. In actual practice, a signal cable of this format has numerous drawbacks as follows:

1. DVI format can only transmit images without sound, and speaker means must be added so that sound can be heard. The wiring of the speaker means complicates the installation.

2. During transmission of image signal through the signal cable at a distance, image signal attenuation occurs, resulting in signal instability and low video signal quality.

3. There is no means to indicate the transmission status during transmission of video signal through the signal cable. If the signal cable fails or is damaged, the user does not know the situation at once, and it will take much time and labor to examine the whole system.

4. When the connector at one end of the signal cable is connected to a wall plate, the connector suspends outside the wall plate and may be stretched away from the wall plate accidentally, interrupting signal transmission.

To eliminate the aforesaid problems, HDMI (High-Definition Multimedia Interface) format is developed.

HDMI is an all-digital audio/video interface capable of transmitting uncompressed streams. HDMI is compatible with High-bandwith Digital Content Protection (HDCP) Digital Rights Management technology. HDMI provides an interface between any compatible digital audio/video source, such as a set-top box, a DVD player, or the like and a compatible digital audio and/or video monitor, such as digital television.

HDMI supports digital video formats, such as SXGA, UXGA, SDTV and HDTV, and digital audio formats, such as CD/DVD-Audio, Dolby Digital/DTS.

A HDMI cable includes a digital audio line for multichannel transmission. HDMI is capable of transmitting 8-channel compressed or non-compressed digital audio signals at a time, eliminating an extra sound source cable and simplifying wiring arrangement.

When comparing to DVI's 8-bit color depth, HDMI provies 10-bit~12-bit color depth for every prime color. Further, a HDMI connector has a size about equal to a USB connector that is much smaller than a DVI connector. Similar to a regular consumer electronic video end connector, a HDMI connector is plug and ply design.

In the computer world, HDMI is already found on many peripherals and a few newer video cards, with adoption rapidly increasing.

SUMMARY OF THE INVENTION

The present invention has been accomplished under the circumstances in view.

According to one aspect of the present invention, the wall plate assembly comprises a wall plate, a support device fastened to the wall plate to support an electric connector, and a signal amplifier mounted on the back side of the wall plate for receiving the electric connector that is supported on the support device and amplifying the signal transmitting through the connected electric connector. The wall plate has a front recess and an insertion slot cut through the front recess for the insertion of an electric connector. The support device comprises a vertical support frame vertically adjustably fastened to the front recess of the wall plate below the elevation of the insertion slot, and a horizontal support frame horizontally adjustably coupled to the vertical support frame. Therefore, the support device can be adjusted vertically as well as horizontally to fit the size of the installed electric connector. The signal amplifier has a connection interface for receiving the installed electric connector, and indicator lights for indicating the operation status of the signal amplifier.

According to another aspect of the present invention, the connection interface is a HDMI (High-Definition Multimedia Interface) connector for receiving a HDMI (High-Definition Multimedia Interface) connector of a HDMI (High-Definition Multimedia Interface) cable.

DETAILED DESCRIPTION OF THE PREFERRED EMBODIMENT

Figure 1:
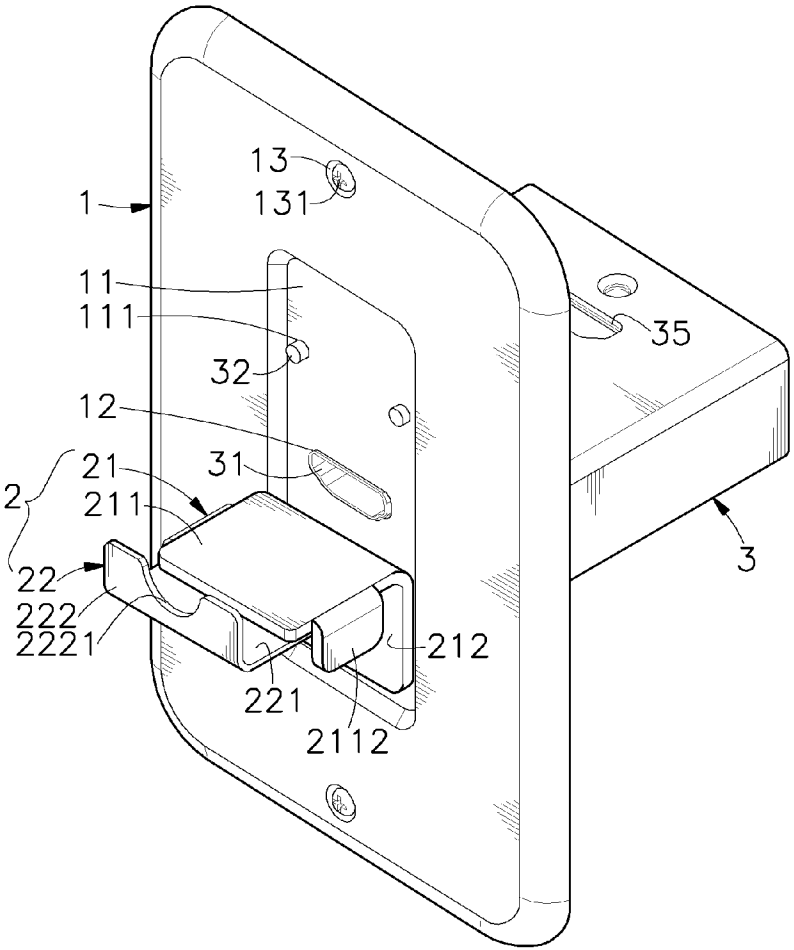
FIG. 1 is an oblique elevation of a wall plate assembly for electric socket in accordance with the present invention.
Figure 2:
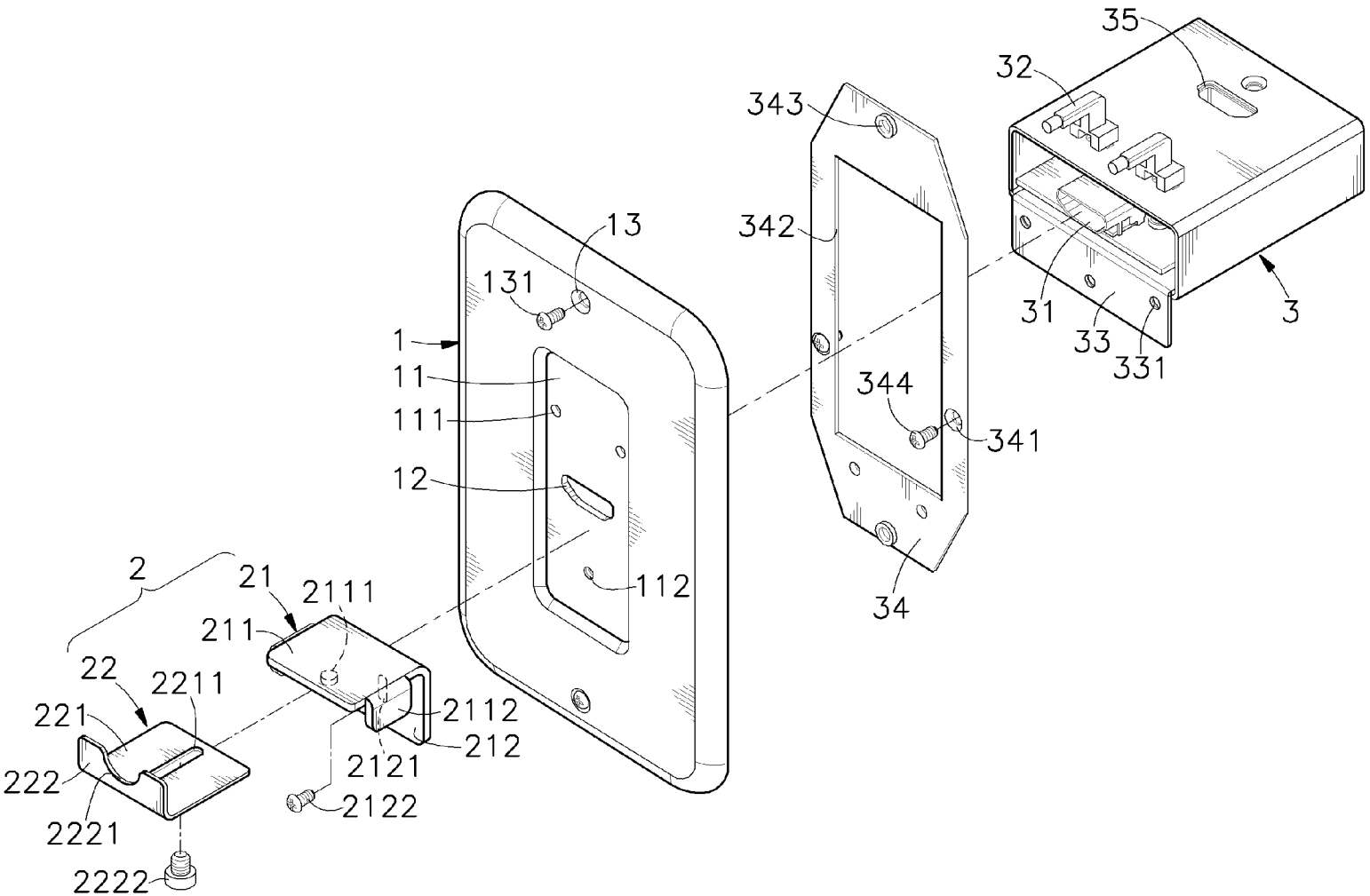
FIG. 2 is an exploded view of the wall plate assembly for electric socket in accordance with the present invention.
Figure 3:
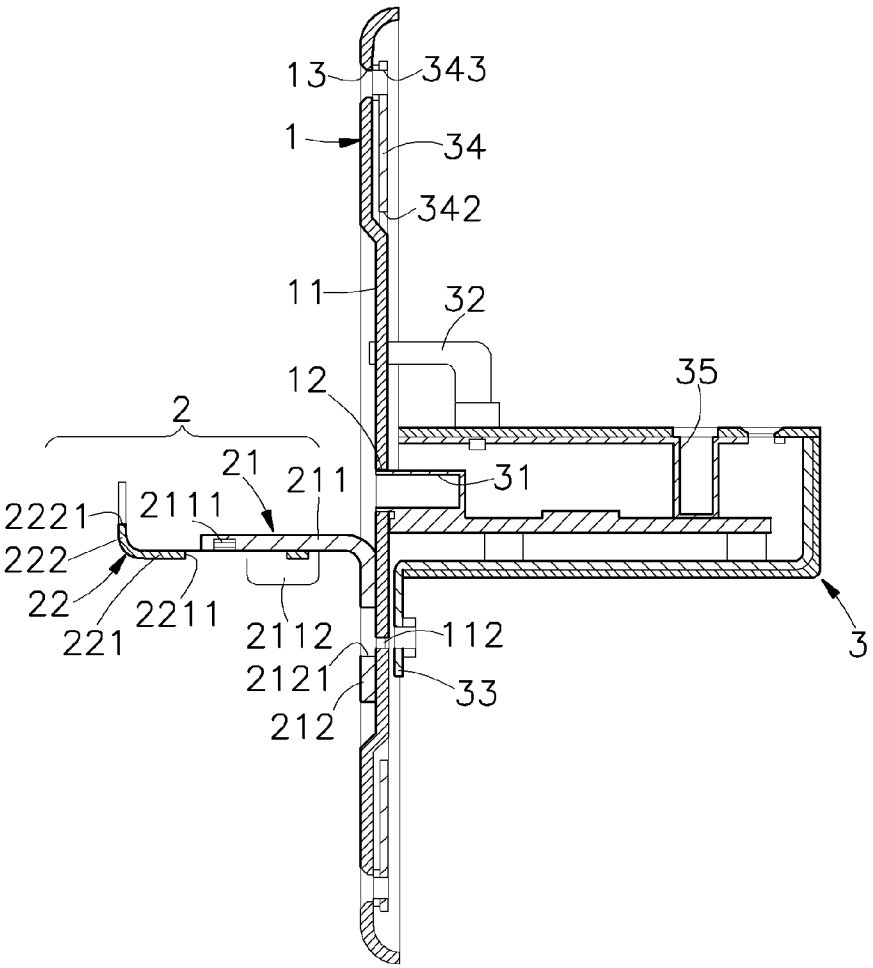
FIG. 3 is a sectional side view of the wall plate assembly according to the present invention.
Figure 4:
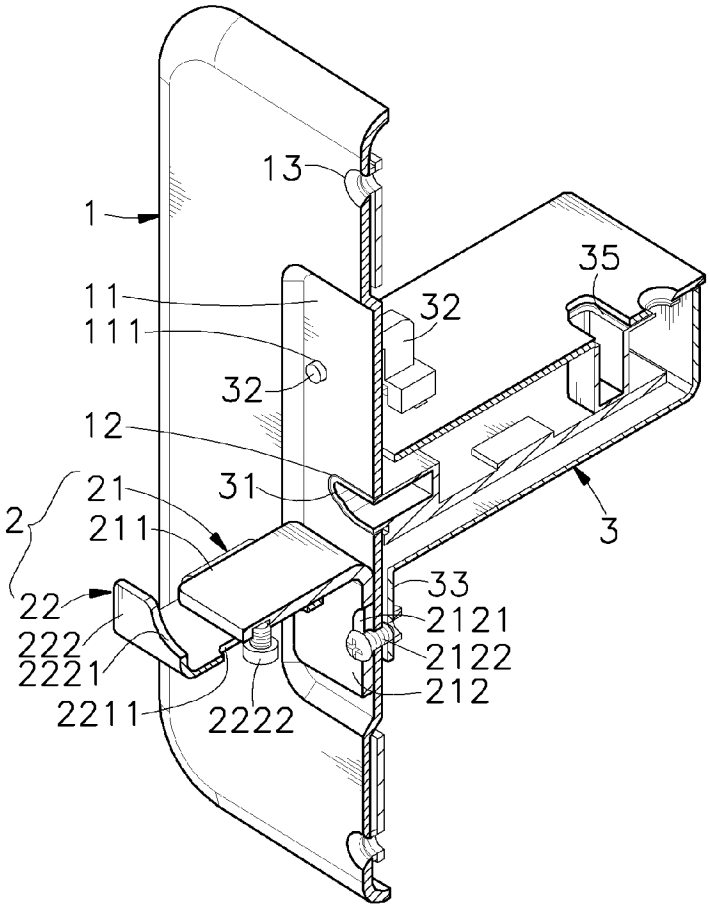
FIG. 4 is a sectional elevation of the wall plate assembly according to the present invention.

Referring to FIGS. 1~4, a wall plate assembly for electric socket in accordance with the present invention is shown comprised of a wall plate 1, a support device 2 and a signal amplifier 3.

The wall plate 1 has a front recess 11 on the front side, an insertion slot 12 cut through the front recess 11 on the middle, a plurality of through holes 111 and a screw hole 112 cut through the front recess 11 at selected locations, and a plurality of mounting holes 13 cut through the front and back side beyond the front recess 11 and respectively mounted with a respective fastening member, for example, screw 131.

The support device 2 is comprised of a vertical support frame 21 and a horizontal support frame 22. The vertical support frame 21 and the horizontal support frame 22 are movable relative to each other. The vertical support frame 21 has a horizontal panel 211 and a vertical panel 212 connected at right angles. The horizontal panel 211 has a bottom screw hole 2111, and two downwardly extending side wings 2112. The vertical panel 212 has a vertical sliding slot 2121. The horizontal support frame 22 is coupled to the bottom side of the horizontal panel 211 of the vertical support frame 21, having a flat horizontal base 221 and an upright wall 222 vertically extending from one side of the flat horizontal base 221. The flat horizontal base 221 has an elongated sliding slot 2221 cut through the top and bottom sides and extending in direction perpendicular to the upright wall 221. The upright wall 222 has an arched top notch 2221. The flat horizontal base 221 of the horizontal support frame 22 is attached to the bottom side of the horizontal panel 211 of the vertical support frame 21 between the two side wings 2112, and then a screw 2222 is inserted through the elongated sliding slot 2221 and threaded into the bottom screw hole 2111 to lock the horizontal support frame 22 to the vertical support frame 21. When loosened the screw 2222, a user can move the horizontal support frame 22 relative to the vertical support frame 21 to adjust the horizontal width of the support device 2.

The signal amplifier 3 has a connection interface 31 at one side, at least one indicator light 32 disposed on the outside and electrically connected to the connection interface 31, a locating frame 33 disposed adjacent to the connection interface 31, a plurality of locating holes 331 formed on the locating frame 33, a mounting plate 34 for fastening the locating frame 33 to the wall plate 1, and an adapter interface 35 formed in the outside wall and electrically connected to the connection interface 31. The mounting plate 34 has a rectangular opening 342 which receives the back protruding part of the face plate 1 corresponding to the front recess 11, two locating holes 341 disposed at two opposite lateral sides and respectively fastened to one respective locating hole 331 of the locating frame 33 with a respective fastening member, for example, screw 344, and a plurality of mounting through holes 343 corresponding to the mounting holes 13 of the wall plate 1.

During installation, the support device 2 is set in the front recess 11 of the wall plate 1, and a screw 2122 is inserted through the vertical sliding slot 2121 and threaded into the screw hole 112 to lock the vertical support frame 21 to the wall plate 1 at the selected elevation. Further, the mounting through holes 343 of the mounting plate 34 are respectively connected to the mounting holes 13 of the wall plate 13 by the respective screws 131. When installed, the indicator lights 32 of the signal amplifier 3 are respectively inserted into the through holes 111 of the wall plate 1 and the connection interface 31 is aimed at the insertion slot 12 of the wall plate 1.

Figure 5:
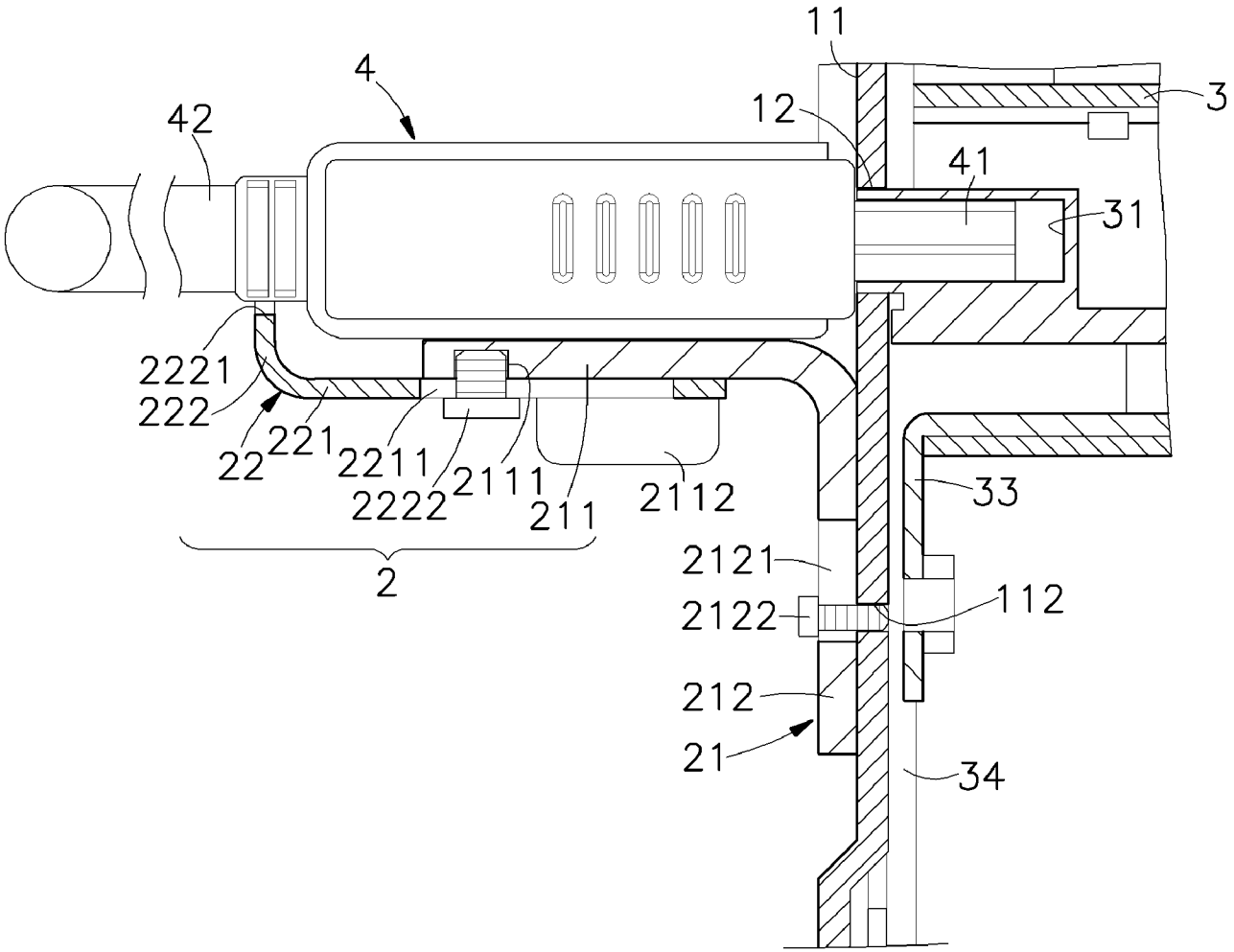
FIG. 5 is an installed view of the present invention before adjustment of the support device.
Figure 6:
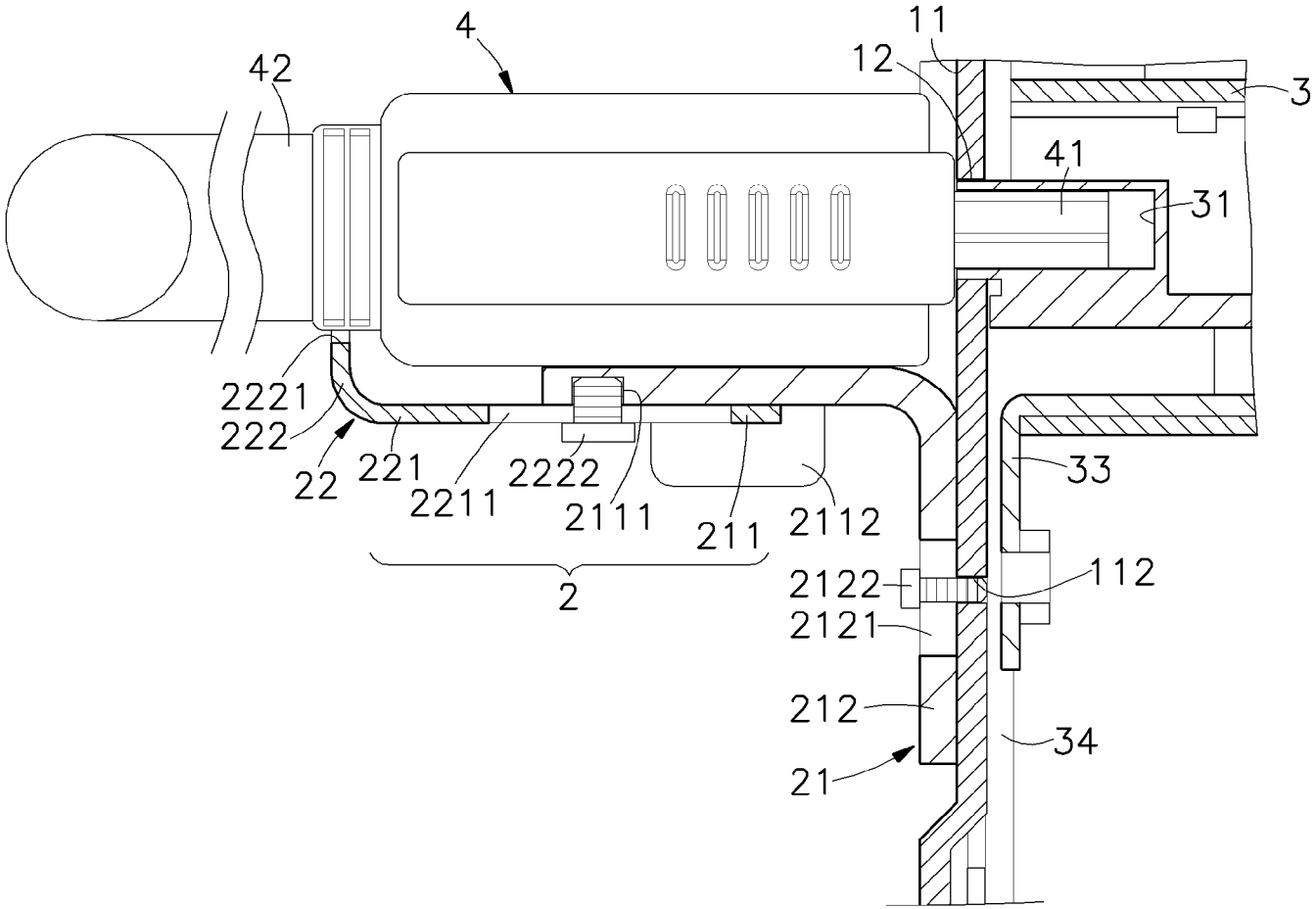
FIG. 6 corresponds to FIG. 5, showing the support device adjusted subject to the size of the HDMI connector.

Referring to FIGS. 5 and 6, the wall plate assembly is adapted to receive an electric connector 4 at one end of a cable 42. The electric connector 4 is a HDMI (High-Definition Multimedia Interface) connector that is an all-digital audio/video interface capable of transmitting uncompressed streams. Therefore, the electric connector (HDMI connector) 4 provides an interface between any compatible digital audio/video source and a compatible digital audio and/or video monitor. Further, the electric connector (HDMI connector) 4 has a connection portion 41 at the front side. During installation, the electric connector (HDMI connector) 4 is supported on the horizontal panel 211 of the vertical support frame 21 with the connection portion 41 inserted through the insertion slot 12 of the wall plate 1 into the connection interface 31 of the signal amplifier 3 and the cable 42 positioned in the arched top notch 2221 of the upright wall 222 of the horizontal support frame 22 of the support device 2. After installation, the cable 42 and the electric connector (HDMI connector) 4 can transmit 720 p/1080 i image signal through the connection portion 41.

When a different type or size of electric connector (HDMI connector) 4 is used, the screw 2122 can be loosened for allowing adjustment of the elevation of the vertical support frame 21 relative to the wall plate 1 to let the connection portion 41 of the electric connector (HDMI connector) 4 be inserted through the insertion slot 12 of the wall plate 1 into the connection interface 31 of the signal amplifier 3, and the screw 2222 can be loosened for allowing adjustment of the horizontal support frame 22 relative to the vertical support frame 21 to have the electric connector (HDMI connector) 4 be positively supported on the horizontal panel 211 of the vertical support frame 21 and stopped between the wall plate 1 and the upright wall 222 of the horizontal support frame 22. After adjustment, the screws 2122 and 2222 are respectively fastened tight to lock the vertical support frame 21 to the wall plate 1 and the horizontal support frame 22 to the vertical support frame 21 respectively.

Figure 7:
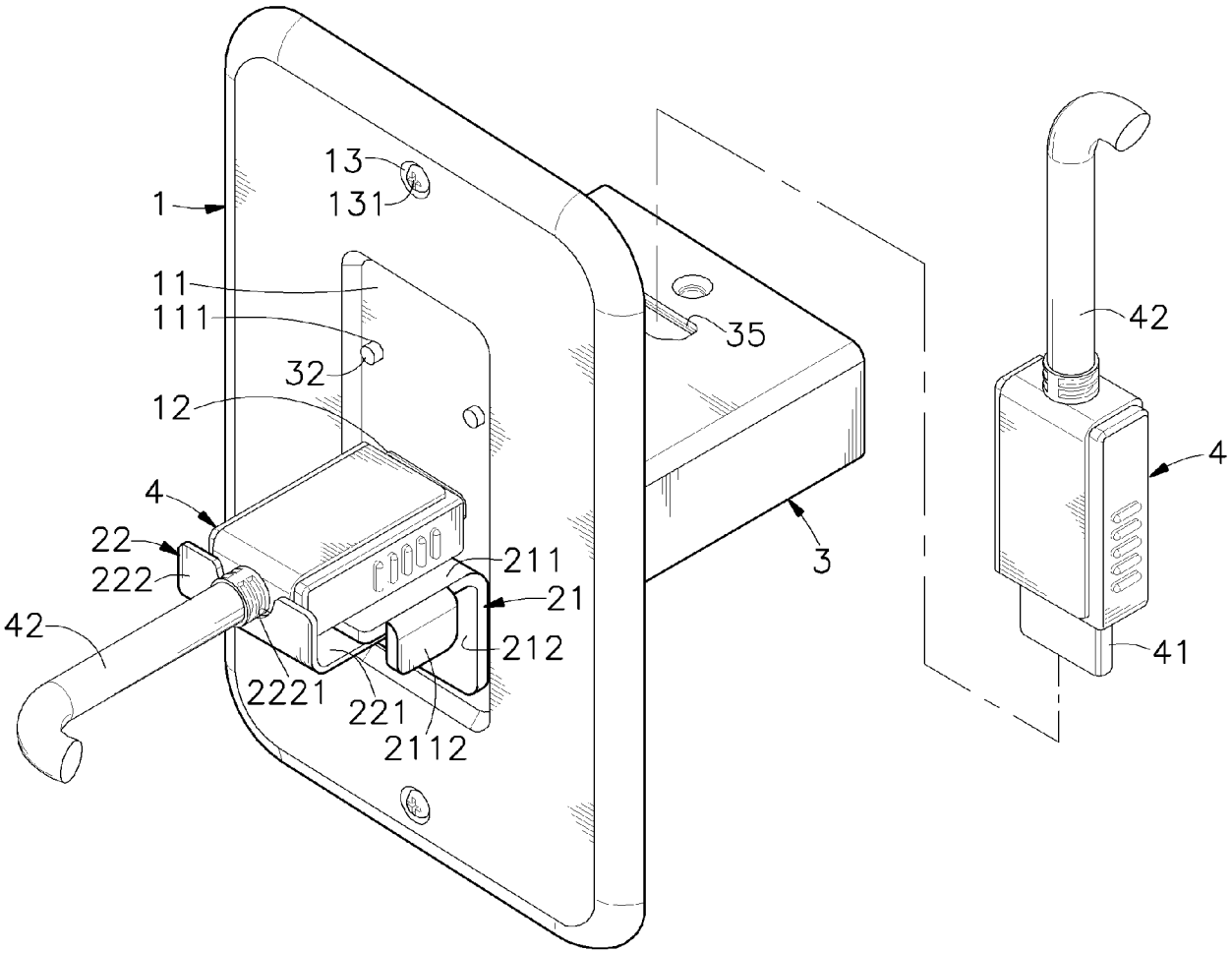
FIG. 7 is a schematic drawing of the present invention, showing connection of the signal amplifier of the wall plate assembly between two HDMI cables.
Figure 8:
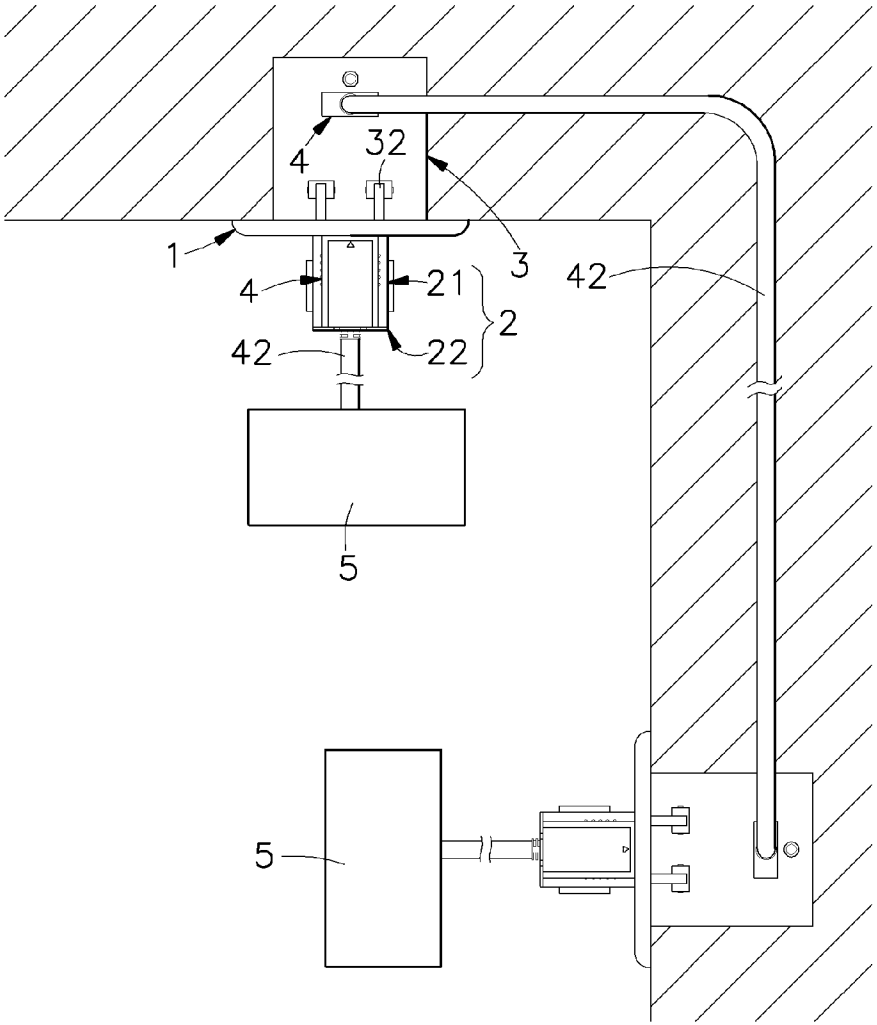
FIG. 8 is a schematic drawing showing an application example of the present invention.

Referring to FIGS. 7 and 8, the screws 131 that are mounted in the mounting holes 13 of the wall plate 1 and the mounting through holes 343 of the mounting plate 34 are fastened to the ceiling, wall or floor to affix the wall plate assembly in place. When two wall plate assemblies are installed in the ceiling, wall or floor at different locations, and respectively connected to an electronic device 5 (video monitor, video game consol, multimedia player, VCD player, DVD player, projector, set-top box, etc.) through a respective HDMI cable 42, another HDMI cable 42 is used and installed in the ceiling, wall or floor with the two HDMI connectors 4 thereof respectively connected to the adapter interfaces 35 of the signal amplifiers 3 of the wall plate assemblies respectively for audio/video signal transmission between the two electronic devices 5. By means of the signal amplifier 3 to amplify the signal, the invention enhances signal gain and eliminates signal attenuation problem during transmission.

Further, the indicator lights 32 of the signal amplifier 3 are respectively inserted into the through holes 111 of the wall plate 1. After connection of one HDMI connector 4 to the connection interface 31 of the signal amplifier 3, the indicator lights 32 indicate the operation status. In case of an operation failure or circuit damage, the indicator lights 32 give an indication so that a repair or replacement work can be quickly done.

As stated above, the invention provides a wall plate assembly, which has the following features:

1. The wall plate assembly comprises a wall plate 1 with an insertion slot 12, and a support device 2 provided at the front side of the wall plate 1 below the insertion slot 12 to support the installed HDMI connector 4 and to hold installed HDMI connector 4 firmly in place.

2. The support device 2 is comprised of a vertical support frame 21 coupled to the wall plate 1 and vertically adjustable to fit the size of the installed HDMI connector 4, and a horizontal support frame 22 coupled to the vertical support frame 21 and horizontally adjustable to fit the size of the installed HDMI connector 4.

In general, the invention provides a wall plate assembly, which comprises a wall plate for receiving a HDMI connector, a support device coupled to the wall plate and horizontally vertically adjustable to fit the size of the installed HDMI connector so as to hold down the installed HDMI connector firmly in position, and a signal amplifier, which receives the installed HDMI connector and amplifies the signal transmitting through the HDMI connector, enhancing signal gain and eliminating signal attenuation problem.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. A wall plate assembly comprising:

a wall plate, said wall plate having a front recess, and an insertion slot cut through said front recess for the insertion of a HDMI (High-Definition Multimedia Interface) connector of a HDMI (High-Definition Multimedia Interface) cable; and a support device fastened to said front recess of said wall plate to support a HDMI connector, said support device comprising a vertical support frame vertically adjustably fastened to said front recess of said wall plate below the elevation of said insertion slot, said vertical support frame having a vertical sliding slot, a first lock screw inserted through said vertical sliding slot and fastened to said front recess of said wall plate to adjustably lock said vertical support frame to said wall plate, a horizontal support frame horizontally adjustably coupled to said vertical support frame, said horizontal support frame having a flat horizontal base, an elongated sliding slot cut through top and bottom sides of said flat horizontal base, and an upright wall perpendicularly upwardly extending from one side of said flat horizontal base, and an arched notch on a top side of said upright wall for supporting a HDMI cable of a HDMI connector, and a second lock screw inserted through said elongated sliding slot and fastened to said vertical support frame to adjustably lock said horizontal support frame to said vertical support frame.

2. The wall plate assembly as claimed in claim 1, wherein said wall plate has a plurality of mounting holes and a plurality of fastening members mounted in said mounting holes for fastening said wall plate to a part of a building.

3. A wall plate assembly comprising:

a wall plate, said wall plate having a front recess, and an insertion slot cut through said front recess for the insertion of a HDMI (High-Definition Multimedia Interface) connector of a HDMI (High-Definition Multimedia Interface) cable;

a support device fastened to said front recess of said wall plate to support a HDMI connector, said support device comprising a vertical support frame vertically adjustably fastened to said front recess of said wall plate below the elevation of said insertion slot, said vertical support frame having a vertical sliding slot, a first lock screw inserted through said vertical sliding slot and fastened to said front recess of said wall plate to adjustably lock said vertical support frame to said wall plate, a horizontal support frame horizontally adjustably coupled to said vertical support frame, said horizontal support frame having a flat horizontal base, a elongated sliding slot cut through top and bottom sides of said flat horizontal base, and an upright wall perpendicularly upwardly extending from one side of said flat horizontal base, and an arched notch on a top side of said upright wall for supporting a HDMI cable of a HDMI connector, and a second lock screw inserted through said elongated sliding slot and fastened to said vertical support frame to adjustably lock said horizontal support frame to said vertical support frame; and a signal amplifier, said signal amplifier comprising a locating frame fastened to a back side of said wall plate opposite to said support device, a connection interface connected to said insertion slot of said wall plate for receiving a HDMI connector of a first HDMI cable electrically, and an adapter interface electrically connected to said connection interface for receiving a HDMI connector of a second HDMI cable electrically.

4. The wall plate assembly as claimed in claim 3, wherein said wall plate has a plurality of mounting holes and a plurality of fastening members mounted in said mounting holes for fastening said wall plate to a part of a building.

5. The wall plate assembly as claimed in claim 3, wherein said face panel has at least one through holes cut through said front recess above said insertion slot; said signal amplifier comprises at least one indicator light electrically connected to said connection interface and respectively inserted into the at least one through holes of said wall plate.

6. The wall plate assembly as claimed in claim 3, wherein said connection interface and said adapter interface of said signal amplifier are male HDMI (High-Definition Multimedia Interface) connectors.

7. The wall plate assembly as claimed in claim 3, wherein said connection interface and said adapter interface of said signal amplifier are female HDMI (High-Definition Multimedia Interface) connectors.

* * * * *